United States Patent [19]

Fujimura et al.

[11] Patent Number: 4,835,079

[45] Date of Patent: May 30, 1989

[54] ELECTROPHOTOGRAPHIC PHOTOSENSITIVE MEMBER AND ELECTROPHOTOGRAPHIC PROCESS USING THE SAME

[75] Inventors: Naoto Fujimura, Yokohama; Kiyoshi Sakai, Chofu; Masami Okunuki, Tokyo, all of Japan

[73] Assignee: Canon Kabushiki Kaisha, Tokyo, Japan

[21] Appl. No.: 235,804

[22] Filed: Aug. 23, 1988

Related U.S. Application Data

[63] Continuation of Ser. No. 129,868, Dec. 4, 1987, abandoned, which is a continuation of Ser. No. 799,108, Nov. 18, 1985, abandoned.

[30] Foreign Application Priority Data

Nov. 21, 1984 [JP] Japan ..... 59-244353

[51] Int. Cl.[4] ..... G03G 5/10

[52] U.S. Cl. ..... 430/58; 430/59; 430/133

[58] Field of Search ..... 430/58, 59, 133

[56] References Cited

U.S. PATENT DOCUMENTS

| | | | |
|---|---|---|---|
| 3,956,524 | 5/1976 | Weigl | 430/57 |
| 4,026,704 | 5/1977 | Rochlitz | 430/67 |
| 4,352,876 | 10/1982 | Suzuki et al. | 430/58 |
| 4,476,208 | 10/1984 | Horie et al. | 430/58 |
| 4,535,042 | 8/1985 | Kitayama et al. | 430/61 |
| 4,578,334 | 3/1986 | Borsenberger et al. | 430/59 |

FOREIGN PATENT DOCUMENTS 1570576 7/1980 United Kingdom .

*Primary Examiner*—John L. Goodrow

*Attorney, Agent, or Firm*—Fitzpatrick, Cella, Harper & Scinto

[57] ABSTRACT

An electrophotographic photosensitive member comprising an organic photoconductive material has a structure that a charge transport layer containing a charge transporting material and a binder and a charge generation layer containing a charge generating material and a binder are laminated in succession in this order on a conductive substrate. The weight ratio of said charge transporting material to said binder in said charge transport layer is not less than 12/10 and said charge generation layer contains a charge transporting material.

6 Claims, No Drawings

ELECTROPHOTOGRAPHIC PHOTOSENSITIVE MEMBER AND ELECTROPHOTOGRAPHIC PROCESS USING THE SAME

This application is a continuation of application Ser. No. 129,868, filed Dec. 4, 1987, which in turn is a continuation of application Ser. No. 799,108, filed Nov. 18, 1985, now abandoned.

BACKGROUND OF THE INVENTION

1. Field of the Invention

The present invention relates to an electrophotographic photosensitive member of a laminar structure, and more particularly, to such a photosensitive member of the structure where at least a charge transport layer and a charge generation layer are laminated in succession in this order on a conductive substrate.

2. Description of the Prior Art

Heretofore there are well known electrophotographic photosensitive members using as a photosensitive component an inorganic photoconductive material such as selenium, cadmium, sulfide, zinc oxide and the like.

On the other hand, since it was found that some organic compounds show photoconductive property, many kinds of organic photoconductive materials have been developed. There are known, for example, organic photoconductive polymers such as poly-N-vinylcarbazole, polyvinylanthracene and the like, low molecular weight organic photoconductors such as carbazole, anthracene, pyrazolines, oxadiazoles, hydrazones, polyarylalkanes and the like and organic dyes or pigments such as phthalocyanine pigments, azo pigments, cyanine dyes, polycyclic quinone pigments, perylene type pigments, indigo dyes, thioindigo dyes, squaric acid methine dyes and the like. In particular, since organic pigments or dyes having photoconductivity are synthesized more easily than inorganic materials, and since the bounds of employable compounds showing photoconductivity for an appropriate wavelength range have been enlarged, many kinds of photoconductive organic pigments or dyes have been proposed. As disclosed in, for example, U.S. Pat. No. 4,123,270, No. 4,247,614, No. 4,251,613, No. 4,251,614, No. 4,256,821, No. 4,260,672, No. 4,268,596, No. 4,278,747, No. 4,293,628, etc., there is already known an electrophotographic photosensitive member in which the photosensitive layer is functionally divided into a charge generation layer and a charge transport layer, and in which certain photoconductive disazo pigments are utilized as the charge generation material.

In particular, with respect to azo type pigments, variation of materials is earnestly investigated recently, and some materials are in practical use.

In general, such photosensitive member is provided with a charge generation layer and a charge transport layer superposed in this order on a conductive substrate, in which said charge transport layer contains a strongly electron-donating charge transport material to facilitate the transportation of positive charge, and such photosensitive member is negatively charged.

This is due to a fact that negative charge transporting materials are generally unsatisfactory in performance and are frequency unacceptable for commercial applications due to strong carcinogenecity thereof.

However, negative corona discharge results in formation of significant ozone, giving rise to an additional cost for an ozone filter in the copying machine for removing such ozone. Also periodic maintenance becomes indispensable since such ozone filter deteriorates gradually in performance during prolonged use.

Further the negative corona discharge tends to result in an uneven discharge, for example, due to smears on the discharge wires, thus leading to uneven image density. Also the generated ozone undesirably affects the service life of the organic photoconductor.

Furthermore, the negative corona discharge is associated with deterioration of the surface of photoconductor by the generated ozone and deposition of ionic substances, generated by the discharge, onto the photoconductor, whereby the surface potential thereof is entirely or locally reduced, thus eventually causing entire or local blurs or defects in the electrophotographically reproduced image.

On the other hand, positive corona discharge generates ozone in an amount of 1/5 to 1/10 in comparison with the case of negative corona discharge, is much less associated with uneven discharge caused by the smears of the discharge wires, and is more desirable for the service life of the photosensitive member.

A positively chargeable laminar-structure photosensitive member can be constructed, for example, by superposing a positive charge transport layer and a charge generation layer in this order on a conductive substrate.

However, if such a photosensitive member is used in a copy process, for example, comprising the steps of charging, imagewise exposure, development, transfer of toner images onto a receiving member, separation of the receiving member from the photosensitive member, cleaning and discharging, the surface of a photosensitive member will be gradually abraded off. Such abrasion can occur for example, in the steps of image development, image transfer and cleaning. Consequently, after prolonged used, the sensitivity of the photosensitive member changes to a great extent, or in extreme cases, the photosensitivity will be entirely lost.

SUMMARY OF THE INVENTION

One object of the present invention is to provide a highly sensitive photosensitive member.

Another object of the present invention is to provide a photosensitive member having excellent durability.

Still another object of the present invention is to provide a photosensitive member capable of being positively charged where ozone is generated only in small amount and uneven image density is much less likely to occur.

A further object of the present invention is to provide an electrophotographic process using said photosensitive member.

According to the present invention, there is provided an electrophotographic photosensitive member which comprises an organic photoconductive material comprising a charge transport layer containing a charge transporting material and a binder and a charge generation layer containing a charge generating material and a binder laminated in succession in this order on a conductive substrate, the weight ratio of said charge transporting material to said binder in said charge transport layer being not less than 12/10 and said charge generation layer containing a charge transporting material.

DESCRIPTION OF THE PREFERRED EMBODIMENTS

The electrophotographic characteristics largely depends upon the charge transport layer. Basically, it is desirable that a non-conductive binder is not contained in a large quantity. However, in case of a photosensitive member for negative charging, since the charge transporting material in the surface layer, in general, is susceptible to UV-ray, ozone or the like, the photosensitive member containing a small quantity of binder is lacking in durability and mechanical strength. On the other hand, in case of the photosensitive member for positive charging of the present invention, since the surface layer is a charge generation layer, degradation of the charge transporting material is prevented, and thus the quantity of a binder contained in the charge transport layer can be reduced.

In the present invention, the weight ratio of a charge transporting material to a binder in the charge transport layer is not less than 12/10, preferably 15/10–30/10. The weight ratio less than 12/10 deteriorates charging characteristic or sensitivity.

In addition, in accordance with the present invention, the film thickness of the charge generation layer may be 0.5–10 microns, preferably 1–10 microns, by incorporating a charge transporting material into the charge generation layer.

In case of the film thickness of less than 0.5 microns, the charge generation layer is abraded in a prolonged use and the sensitivity is reduced. On the other hand, it is known that, in case of the film thickness of, in general, greater than 0.5 micron, the memory characteristic is remarkably deteriorated.

In the present invention, however, by incorporating a charge transporting material into the charge generation layer, the upper limit of film thickness can be raised to 10 microns without deteriorating the sensitivity or the memory characteristic. In addition, by doing that, the quantity of added binder can be increased to improve the mechanical strength of the surface portion of the photosensitive member, and thus the sensitivity reduction in a prolonged use can be prevented.

The content of a charge transporting material in the charge generation layer is preferably 10–70% by weight. In case of the content less than 10%, sensitivity and photomemory characteristic are insufficient, and in case of the content greater than 70%, sensitivity reduction is caused by corona discharge, image blur is caused by the reduction of surface resistance, and resolution is lowered.

Examples of the charge generation material to be employed in the present invention are phthalocyanine pigments, anthanthrone pigments, dibenzpyrene pigments, pyranthrone pigments, trisazo pigments, disazo pigments, azo pigments, indigo pigments, quinacridone pigments, asymmetric quinocyanine, quinocyanine, azulenium salts, pyrylium dyes, thiopyrylium dyes, cyanine dyes, xanthene dyes, quinonimine dyes, tripheylmethane dyes, styryl dyes and the like. In addition to the above-enumerated pigments or dyes, inorganic materials such as a-Si, a-Se, CdS, Se-Te and the like are also employable.

Examples of the binder to be employed are polyarylate resins, polysulfon resins, polyamide resins, acrylic resins, acrylonitrile resins, methacrylic resins, polyvinyl chloride resins, polyvinyl acetate resins, phenolic resins, epoxy resins, polyester resins, alkyd resins, polycarbonate, polyurethane, and copolymers containing at least two of the monomer unit constituting the foregoing resins, such as styrene-butadiene copolymers, styrene-acrylonitrile copolymers, styrene-maleic acid copolymers and the like.

The weight ratio of the charge generating material to the binder is preferably not more than 3/1. The charge generation layer may contain lubricant oils, solid lubricants such as teflon, powdered solids for improvement of mechanical strength or the like.

Examples of the charge transporting materials to be employed in the present invention are: pyrene, N-ethylcarbazole, N-isopropylcarbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine; hydrazones such as p-diethylaminobenzaldehyde-N,N-diphenylhydrazone, p-diethylaminobenzaldehyde-N-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzthiazolinone-2-hydrazone and the like; 2,5-bis(p-diethylaminophenyl)-1,3,4-oxadiazole; pyrrazolines such as 1-phenyl-3-(p-diethylaminostyryl)-5-(p-diethylaminophenyl)pyrrazoline, 1-[quinolyl(2)]-3-(p-diethylaminostyryl)-5-(p-diethylaminophenyl)pyrrazoline, 1-[pyridyl(2)]-3-(p-diethylaminostyryl)-5-(p-diethylaminophenyl)pyrrazoline, 1-[6-methoxypyridyl(2)]-3(p-diethylaminostyryl)-5-(p-diethylaminophenyl)pyrrazoline, 1-[pyridyl(3)]-3-(p-diethylaminostyryl)-5-(p-diethylaminophenyl)pyrrazoline, 1-[lepidyl(2)]-3-(p-diethylaminostyryl)-5-(p-diethylaminophenyl)pyrrazoline, 1-[pyridyl(2)]-3-(p-diethylaminostyryl)-4-methyl-5-(p-diethylaminophenyl)pyrrazoline, 1-[pyridyl(2)]-3-(α-methyl-p-diethylaminostyryl)-5-(p-diethylaminophenyl)pyrrazoline, 1-phenyl-3-(p-diethylaminostyryl)-4-methyl-5-(p-diethylaminophenyl)pyrrazoline, 1-phenyl-3-(α-benzyl-p-diethylaminostyryl)-5-(p-diethylaminophenyl)pyrrazoline, spiropyrrazoline and the like; oxazole compounds such as 2-(p-diethylaminostyryl)-6-diethylaminobenzoxazole, 2-(p-diethylaminophenyl)-4-(p-dimethylaminophenyl)-5-(2-chlorophenyl-)oxazole and the like; thiazole compounds such as 2-(p-diethylaminostyryl)-6-diethylaminobenzothiazole and the like; triarylmethane compounds such as bis(4-diethylamino-2-methylphenyl)phenylmethane and the like; polyarylalkanes such as 1,1-bis(4-N,N-diethylamino-2-methylphenyl)heptane, 1,1,2,2-tetrakis(4-N,N-dimethylamino-2-methylphenyl)ethane and the like; triphenylamine, poly-N-vinylcarbazole, polyvinylpyrene, polyvinylanthracene, polyvinylacridine, poly-9-vinylphenylanthracene, pyrene-formaldehyde resin, ethylcarbazole-formaldehyde resin and the like.

These charge transporting materials may be used individually or in combination.

Formation of the charge transport layer or charge generation layer can be carried out by, for example, dip coating, spray coating, spinner coating, bead coating, Meyer bar coating, blade coating, roller coating, curtain coating or the like.

In case that the conductive substrate is a conductive drum such as an Al drum, if dip coating is used for forming the charge generation layer, a part of charge transporting material richly contained in the charge transport layer previously formed may dissolve into the coating liquid for forming a charge generation layer since the charge transport layer is exposed to the coating liquid for a considerably long time.

Accordingly, the charge generation layer may be formed preferably by spray coating in such a case.

The photosensitive layer comprising the above-explained laminate structure of a charge generation layer and a charge transport layer, is provided on a substrate having a conductive layer. Said substrate having a conductive layer may be a substrate which itself is conductive such as aluminum, aluminum alloys, copper, zinc, stainless steel, vanadium, molybdenum, chromium, titanium, nickel, indium, gold, platinum and the like; a plastic substrate such as polyethylene, polypropylene, polyvinyl chloride, polyethylene terephthalate, acrylic resin, polyethylene fluoride and the like, provided with a vacuum vapor deposited layer of aluminum, an aluminum alloy, indium oxide, tin oxide or an indium oxide-tin oxide alloy; a plastic substrate coated with particles of a conductive material such as carbon black, silver and the like mixed with a suitable binder; a plastic or paper substrate impregnated with conductive particles; or a plastic substrate containing conductive polymer.

The film thickness of the photosensitive layer is 5–50$\mu$, preferably 15–25$\mu$.

Between the conductive layer and the photosensitive layer, there may be provided an underlayer having the functions of barrier and adhesion. Said underlayer can be composed of casein, polyvinyl alcohol, nitrocellulose, ethylene-acrylic acid copolymer, or polyamides such as nylon-6, nylon-66, nylon-610, copolymerized nylon, alkoxymethylated nylon, and the like. polyurethane, gelatin, aluminum oxide or the like. The thickness of said underlayer is usually not exceeding 5$\mu$, preferably in a range of from 0.5 to 3$\mu$. For achieving said barrier function, the resistivity of said layer is preferably not less than $10^7$ $\Omega$cm.

Since the aforementioned charge transporting material, in general, is susceptible to smear or degradation by UV-ray, ozone, oil, metal cuttings or the like, a protective layer may optionally be provided on the surface of the photosensitive layer. The surface resistivity of the protective layer is desirably larger than $10^{11}\Omega$ so that a latent image may be formed on the protective layer. Such a protective layer can be formed by coating a liquor composed of a resin such as polyvinyl butyrals, polyesters, polycarbonates, acrylic resins, methacrylic resins, nylons, polyimides, polyarylates, polyurethanes, styrene-butadiene copolymers, styrene-acrylic acid copolymers, styrene-acrylonitrile copolymers and the like dissolved in a suitable organic solvent on the photosensitive layer and then drying. In this formation, the film thickness of the protective layer is generally 0.05–20 microns, prederably 0.2–5 microns. In this protective layer, there may be contained additives such as UV-ray absorbents, silicone oils, teflons, $SiO_2$, $Al_2O_3$, $TiO_2$ and the like.

In case of using a photosensitive member laminated in the order of a conductive layer, a charge transport layer and a charge generation layer, since the charge transporting material is a hole transporting material, the surface of the charge generation layer must be charged positively. After charged, it is subjected to exposure, and in the charge generation layer are formed holes to be injected to the charge transport layer. On the other hand, electrons formed by exposure reach the surface to neutralize the positive charge, and then the surface charge decays resulting in electrostatic contrast between the exposed and the unexposed portion. The thus formed electrostatic latent image is developed with a negatively charged toner to obtain a visible image. The visible image may be directly fixed, or transferred to a paper, a plastic film or the like, then developed and fixed.

Also, the electrostatic latent image on the photosensitive member may be transferred onto an insulating layer of receiving paper before development and fixing. The developing agent and process and the fixing process are optionally selected from known agents and processes, and not limited to specific ones.

The electrophotographic photosensitive member of the present invention is applicable not only to electrophotographic copying machines but also to other electrophotographic fields such as laser beam printers or cathode ray tube printers.

The present invention is illustrated in the following examples.

Example 1

A solution of casein in aqueous ammonia (casein 11.2 g, 28% aq. ammonia 1 g, water 222 ml) was applied to aluminum sheet by means of a Meyer bar and dried to form a layer of 1.0$\mu$ thick on the sheet.

Then, a solution was prepared by dissolving 12 g of a hydrazone compound represented by the structural formula

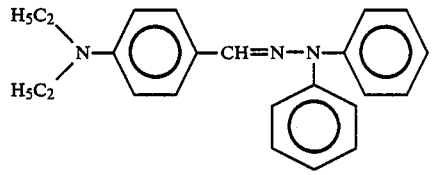

and 10 g of a poly(methyl methacrylate) resin (number average mol. wt. 100,000) in 65 g of monochlorobenzene. The solution was applied to the above underlayer by means of a Meyer bar and dried to form a charge transport layer.

Next, a solution was prepared by dissolving 5 g of a poly(methyl methacrylate) resin in 700 g of monochlorobenzene. To the solution was added 10 g of a disazo pigment represented by the structural formula

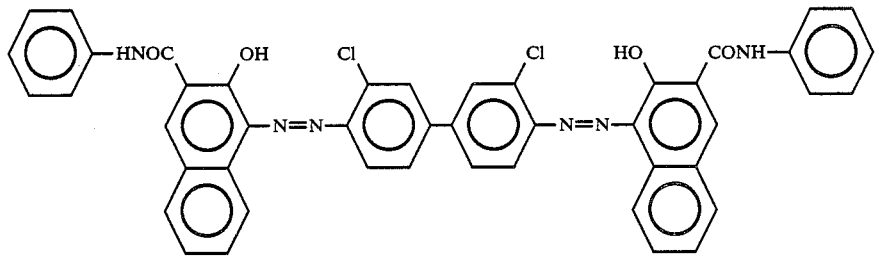

and 12 g of the above hydrazone compound, followed by dispersing in a sand mill for 10 hours. The resulting dispersion was applied to the previously formed charge transport layer by a dipping method and dried to form a charge generation layer of 5μ thick. A photosensitive member of Example 1 was manufactured as described above.

Comparative Example 1

A photosensitive member was manufactured by the same procedure as in Example 1 except that the amount of the hydrazone compound in the charge transport layer formed in Example 1 was changed to 10 g and the charge generation layer was deprived of the hydrazone compound.

The electrophotographic photosensitive member thus prepared was corona-charged at +5 KV in a static fashion by using an electrostatic copying paper testing machine (Model SP-248, mfd. by Kawaguchi Denki Co., Ltd.), retained for 1 second in the dark, and exposed to light an intensity of 5 lux to examine the charging characteristics. The results are shown in Table 1, wherein $V_D$ is the surface potential, and $E\frac{1}{2}$ is the exposure quantity for halving the potential after decaying for 1 second in the dark.

TABLE 1

| | Charge transporting material/binder (weight ratio) | Surface potential $V_D$ (+V) | $E\frac{1}{2}$ (lux · Sec) |
|---|---|---|---|
| Example 1 | 12/10 | 600 | 2.3 |
| Comparative Example 1 | 10/10 | 550 | 6.5 |

The electrophotographic photosensitive member of Example 1 having the charge transport layer in which the weight ratio of the charge transporting material to the binder is 12/10 exhibits a higher sensitivity than that of comparative Example 1 having the charge transport layer in which the weight ratio of the charge transporting material to the binder is 10/10.

Examples 2–5 and Comparative Examples 2–4

A film, 1.1μ thick, of poly(vinyl alcohol) was formed on an aluminum layer vapor—deposited on a poly(ethylene terephthalate) film by a dip coating method.

Next, except that the materials shown in Table 2 were used in place of the charge transporting material and the charge generating material used in the charge transport layer and the charge generation layer, respectively, in Example 1, electrophotographic photosensitive member of Example 2'5 and Comparative Examples 2–4 were manufactured by the same procedure as in Example 1. Ratios of the charge transporting material to the binder of Examples 2–5 were different from those of Comparative Examples 2–4 in Table 2. Potentials of the electrophotographic photosensitive members thus prepared were measured. The results are shown in Table 3.

Photomemory characteristics added as the examining item were evaluated as the difference $\Delta V_D$ of the surface potential between the portion exposed previously to light at an intensity of 600 lux for 3 minutes and the portion not exposed previously to light.

Charging potential of an electrophotographic photosensitive member having high photomemory characteristics was remarkably lowered to expose to light before charging, and an extreme lowering of the image density and the blank area phenomemon occurred at the portion exposed previously to light.

TABLE 2

| Example No. | Charge transporting material | Weight ratio of charge transporting material binder |
|---|---|---|
| 2 | 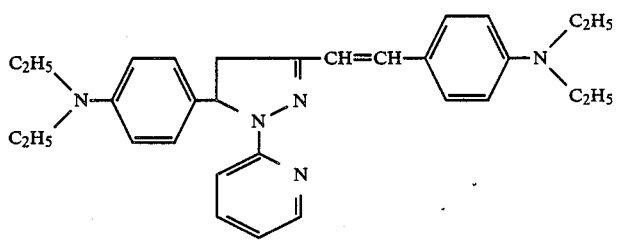 | 12/10 |
| 3 | " | 20/10 |

TABLE 2-continued
| | | |
|---|---|---|
| 4 | 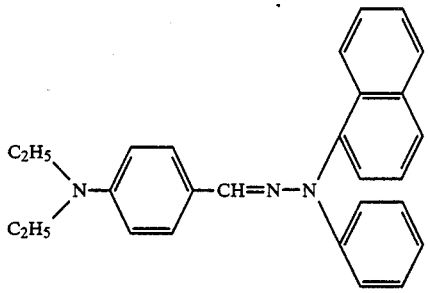 | 12/10 |
| 5 | 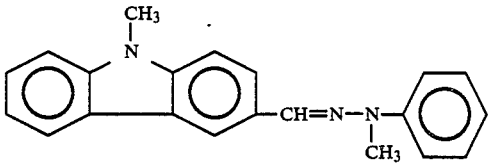 | 15/10 |
| Example No. | Charge generating material |
|---|---|
| 2 | 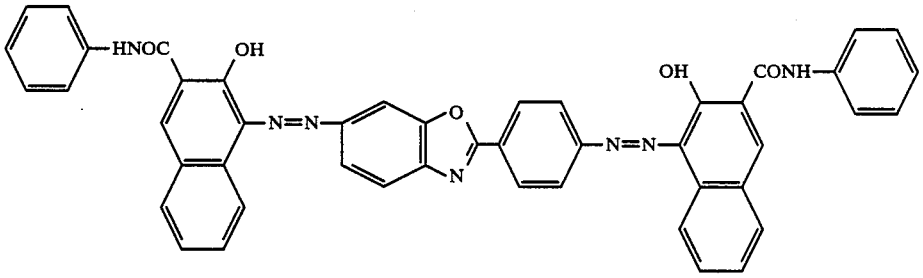 |
| 3 | " |
| 4 | " |
| 5 | 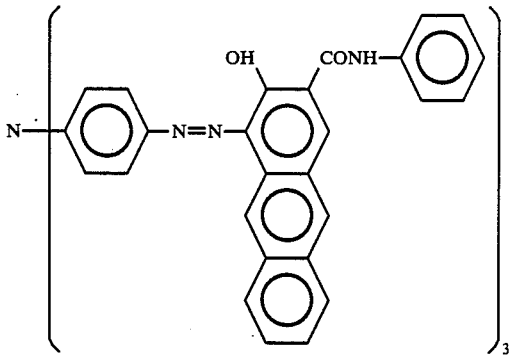 |
| Example No. | Comparative Example No. | Weight ratio of charge transporting material binder |
|---|---|---|
| 2 | 2 | 10/10 |
| 3 | | |
| 4 | 3 | 10/10 |
| 5 | 4 | 10/10 |
TABLE 3
| Example No. | $V_D$ (+V) | E ½ (lux · sec) | PM $\Delta V_D$ (−V) | Comparative Example No. | $V_D$ (+V) | E ½ (lux · sec) | PM $\Delta V_D$ (−V) |
|---|---|---|---|---|---|---|---|
| 2 | 580 | 3.9 | 20 | 2 | 610 | 7.1 | 70 |
| 3 | 620 | 2.8 | 30 | | | | |
| 4 | 590 | 3.8 | 15 | 3 | 590 | 10.0 | 80 |
| 5 | 620 | 2.5 | 10 | 4 | 600 | 8.9 | 75 |

Example 6 and Comparative Example 5

A casein layer was formed according to the same procedure as in Example 1. Next, a charge transport layer was formed according to the same procedure as in Example 1 except that the hydrazone compound in Example 4 was used in place of the hydrazone compound in Example 1.

148 g of phthalic anhydride, 180 g of urea, 25 g of anhydrous cuprous chloride, 0.3 g of ammonium molybdate and 370 g of benzoic acid was reacted at 190° C. for 3.5 hours while stirring and heating. After the completion of the reaction, benzoic acid was distilled under reduced pressure. Then, the residue was filtered off and washed successively with water, acid and finally water to obtain 130 g of crude copper phthalo cyanine.

The crude copper phthalocyanine was dissolved in 1300 g of concentrated sulfuric acid, stirred at room temperature for 2 hours, and then poured into a large amount of ice-water. The precipitated pigments was filtered off, and washed with water until it became neutral.

Next, the resulting pigment was washed with DMF (2.6 l×6 times), MEK (2.65 l×2 times) and water (2.6 l×2 times) while stirring, and was subjected to vacuum drying to obtain 115 g of the purified cooper phthalocyanine.

3 g of poly(vinyl butyral) (BM-2, mfd. by Sekisui Chem. Co., Ltd.) was dissolved in a mixed solvent of 54 g THF and 25 g of cyclohexanone, and 5 g of the above copper phthalocyanine and 2 g of the hydrazone compound in Example 4 were added thereto to form a charge generation layer and an electrophotographic photosensitive member of Example 6 was manufactured. An electrophotographic photosensitive member of Comparative Example 5 was manufactured by the same procedure as in the above except that the charge generation layer was deprived of a hydrazone compound.

The charging characteristics of each photosensitive member were measured by the same manner as in Example 2. The results are shown in Table 4.

TABLE 4

| | Presence of charge transporting material in charge generation layer | Charge transporting material/binder | $V_D$ (−V) | E ½ | PMΔ$V_D$ |
|---|---|---|---|---|---|
| Example 6 | YES | 12/10 | 600 | 2.5 | 20 |
| Comparative Example 5 | NO | 12/10 | 605 | 3.5 | 65 |

As understood from Table 4, both of sensitivity and PM of the photosensitive member of Example 6 are better than those of the photosensitive member of Comparative Example 5. Especially, containing the charge transporting material in the charge generation layer makes PM better.

Example 7

A charge transport layer was formed with the same materials as in Example 1 on an aluminum cylinder of 60 mm in diameter by a dipping method.

45 g of the hydrazone compound used in the charge transport layer was dissolved in 700 g of chlorobenzene in which a polycarbonate resin 45 g (number average mol. wt. 75,000) was dissolved. 10 g of the disazo pigment used in Example 1 was added to the resulting solution and dispersed in a sand mill for 10 hours. This dispersion liquid was applied onto the above charge transport layer by a dipping method. Next, 60 ml of toluene in which 10 g of a styrene resin (HF55, mfd. by Shin-Nittetsu Kagaku Co., Ltd.) was applied thereto by a dipping method to form a layer of 1μ thick to form an electrophotographic photosensitive member.

Using PPC copying machine for positive charging (a trial machine) manufactured by Canon K.K., and above photosensitive aluminum cylinder was subjected to a continuous running test for 10,000 copies, with an initial dark potential of +680 V, an initial light potential of +85 V and with negatively charged toner. After this running test, the photosensitive cylinder was left overnight followed by measurement of the electrical potential.

Along the photosensitive drum in the trial machine for the test, there were provided a positive corona charger, an exposure unit, a developing unit, a positive transfer corona charger, a cleaning blade and a pre-exposure lamp.

The result of the measurement of the electric potential is as follows:

| | Initlal (+V) | After 10,000 copies (+V) |
|---|---|---|
| Light potential | 680 | 700 |
| Dark potential | 85 | 110 |

In this manner the charge in sensitivity was small after the continuous running test, and the image was satisfactory even after 10,000 copies, without unfocused image due to deterioration by ozone, image defects such as abrasion and the like due to blade cleaning and uneven discharge due to smears on the corona wires.

Example 8

15 parts by weight of p-diethylaminobenzaldehyde-α-naphthylphenylhydrazone as a charge transporting material and 10 parts by weight of an acryl-styrene resin (MS.200, mfd. by Shin-Nittetsu Kagaku Co., Ltd.) were dissolved in monochlorobenzene to obtain a coating liquid for the charge transport layer with a viscosity of 120 cp.

An aluminum cylinder of a diameter of 60 mm, a length of 250 mm and a thickness of 0.4 mm was dip-coated with said coating liquid and dried for 80 minutes at 105° to obtain a thickness of 20μ after drying.

10 parts by weight of a disazo pigment represented by the structural formula

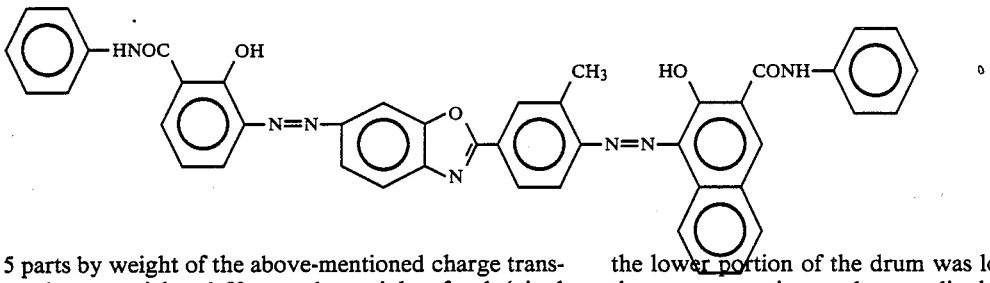

5 parts by weight of the above-mentioned charge transporting material and 50 parts by weight of poly(vinyl butyral) (BM-2, mfd. by Sekisui Kagaku Co., Ltd.) were dispersed by a sand mill method in a solution of a mixture of cyclohexanone and tetrahydrofurane in a ratio of 2:1. The resulting dispersion liquid was filtered through a membrance filter having a pore diameter of 5μ to obtain a coating liquid for the charge generation layer.

The charge generation layer was coated on the charge transport layer by a spray method and dried for 15 minutes at 80° C. to obtain a thickness of 3μ after drying.

The photosensitive drum thus manufactured is referred to as "Sample A".

A photosensitive drum referred to as "Sample B" was manufactured by the same procedure as in the case of the Sample A except that a dipping coating method was used for forming the charge generation layer, having a thickness of 3μ after drying, in place of a spray method.

Further, an electrophotographic photosensitive drum as a comparative sample was manufactured by the same procedure as in the case of the Sample A except that the compounding ratio of the charge transporting material to the binder was changed to 8 parts by weight: 10 parts by weight and a dipping coating method was used for forming the charge generating layer in a way similar to the case of Sample B.

The above three kinds of the photosensitive drums were evaluation in Canon Minicopier PC-20 which was converted to utilize a positive primary charging, a positive transfer charging and negative toner.

The evaluating items are as follows:

(i) Sensitivity (half light quantityt lux.sec when dark potential Vd is 600 V), (ii) Photomemory (the change of Vd being represented by ΔVd one minute after irradiation of 600-lux white light for 3 minutes), and (iii) Image quality.

The result is shown in the following Table.

| | Sensitivity (lux · sec) | Photo-memory ΔVd (V) | Image quality |
|---|---|---|---|
| Sample A | 2.3 | 10 | Resolution, evenness of the image and the like were good. |
| Sample B | 3.6 | 25 | Irregularity of the image and white base fog occurred on the one end portion of the drum. |
| Comparative sample | 7.2 | 80 | White base fog was observed all over the drum. |

As can be seen from the Table, in the case where a compounding ratio of the charge transport material to the binder in the charge transport layer was especially made larger (not less than 15:10), during the dipping coating of the charge generation layer, dipping time of the lower portion of the drum was longer than that of the upper portion and accordingly, elution of the charge transporting material and irregularity of the coating film of the charge transport layer were caused by the solvent in the coating liquid. As the result, the sensitivity was lowered partially (white base fog of the image) and irregularity of the image was occurred.

In the case where a compounding ratio of the charge transport layer to the binder was 8:10, there did not occur irregularity of the image and white base fog on the lower portion of the drum resulting from the elution of the charge transporting material during the dipping coating of the charge generation layer while the sensitivity lowered and white base fog occurred all over the drum since hole injection barrier between the charge generation layer and the charge transport layer was higher.

What is claimed is:

1. An electrophotographic photosensitive member which comprises an organic photoconductive material comprising a charge transport layer containing a charge transporting material and a binder and a charge generation layer containing a charge generating material and a binder laminated in succession in this order on a conductive substrate, the weight ratio of said charge transporting material to said binder in said charge transport layer being not less than 12/10 and said charge generation layer containing a charge transporting material and the content of said charge transporting material in said charge generation layer being 10–70% by weight.

2. An electrophotographic photosensitive member according to claim 1, wherein the thickness of said charge generation layer is 0.5–10μ.

3. An electrophotographic photosensitive member according to claim 2, wherein the thickness of said charge generation layer is 1–10μ.

4. An electrophotographic photosensitive member according to claim 1, wherein said conductive substrate is a conductive drum.

5. An electrophotographic photosensitive member according to claim 4, wherein said charge generation layer is formed by spray coating.

6. An electrophotographic process which comprises forming an electrostatic image by performing a positive charging treatment and image exposure to an electrophotographic photosensitive member which comprises an organic photoconductive material comprising a charge transport layer containing a charge transporting material and a binder and a charge generation layer containing a charge generating material and a binder laminated in succession in this order on a conductive substrate, the weight ratio of said charge transporting material to said binder in said charge transport layer being not less than 12/10 and said charge generation layer containing a charge transporting material and the content of said charge transporting material in said charge generation layer is 10–70% by weight.

* * * * *